United States Patent [19]

Hale

[11] 4,400,644

[45] Aug. 23, 1983

[54] SELF-INDEXING INSULATING SUPPORT RODS FOR AN ELECTRON GUN ASSEMBLY

[75] Inventor: John R. Hale, Lancaster, Pa.

[73] Assignee: RCA Corporation, New York, N.Y.

[21] Appl. No.: 258,740

[22] Filed: Apr. 29, 1981

[51] Int. Cl.[3] ..... H01J 19/42; H01J 29/46; H01J 1/88

[52] U.S. Cl. ..... 313/256; 313/243; 313/244; 313/456; 313/457

[58] Field of Search ..... 313/243, 256, 402, 404, 313/407, 439, 440, 456, 457

[56] References Cited

U.S. PATENT DOCUMENTS

| | | | |
|---|---|---|---|
| 2,943,227 | 6/1960 | Levin | 313/256 |
| 3,085,172 | 4/1963 | Smith | 313/82 |
| 3,144,577 | 8/1964 | Tyson et al. | 313/256 |
| 3,201,637 | 8/1965 | Synder | 313/256 |
| 3,277,328 | 10/1966 | Borman | 313/82 |
| 3,484,641 | 12/1969 | Drees | 313/251 |
| 3,609,400 | 9/1971 | Marks et al. | 313/70 C |
| 3,816,789 | 6/1974 | Sawagata et al. | 313/243 |
| 4,169,239 | 9/1979 | Ehata et al. | 315/16 |
| 4,338,543 | 7/1982 | Handel | 313/457 |

FOREIGN PATENT DOCUMENTS

| | | |
|---|---|---|
| 422614 | 1/1935 | United Kingdom . |
| 611379 | 10/1948 | United Kingdom . |
| 897175 | 5/1962 | United Kingdom . |

*Primary Examiner*—Eugene R. La Roche
*Assistant Examiner*—Vincent De Luca
*Attorney, Agent, or Firm*—Eugene M. Whitacre; Dennis H. Irlbeck; Vincent J. Coughlin, Jr.

[57] ABSTRACT

A novel electron gun assembly having at least one generally longitudinally-extending electron beam path includes a plurality of electrodes attached to at least two electrically-insulating support rods. Each of the support rods has a surface having at least two indexing cavities formed therein for aligning the support rods along the beam path.

5 Claims, 6 Drawing Figures

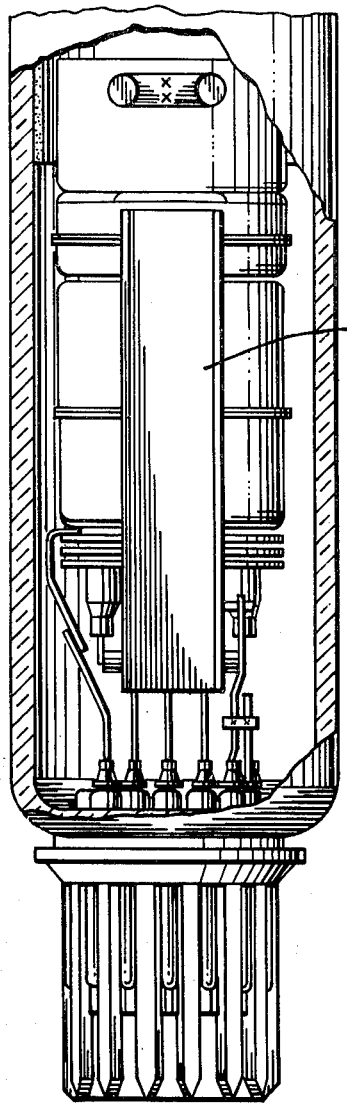
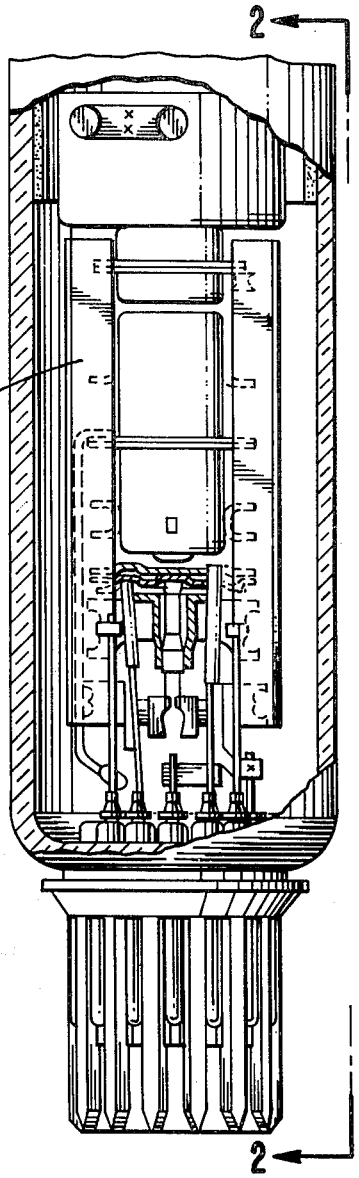
PRIOR ART
Fig. 2
Fig. 1

SELF-INDEXING INSULATING SUPPORT RODS FOR AN ELECTRON GUN ASSEMBLY

BACKGROUND OF THE INVENTION

The present invention relates to electron gun assemblies, and particularly to self-indexing pressed multiform support rods for such gun assemblies.

The electrostatic lens elements of an electron gun assembly are serially arranged to accelerate and focus at least one electron beam along a generally longitudinally-extending electron beam path. The lens elements of the gun assembly are mechanically secured to at least a pair of generally longitudinally-extending insulating support rods by means of support tabs extending from the lens elements and embedded into the support rods. The support rods are formed by pressing a glass powder in a mold. The support rods are subsequently fired to strengthen the rods, to fix the dimension of the rods and to remove volatile matter from the pressed support rods.

The support tabs may be integral with the lens element or the support tabs may be attached, for example by welding, to the body of the lens elements. In either case, the portions of the support tabs embedded into the support rods include shaped projections or claws formed into the end of the support tabs to firmly anchor the tabs within the support rods. Attachment of the tabs to the support rods is accomplished in an operation called beading. Occasionally, during the beading operation, one or more of the support rods become misaligned resulting in improper spacing between lens elements or resulting in incomplete coverage of the claw of the support tab by the insulating support rod. Either condition is undesirable and causes distortion of the electrostatic fields within the electron gun assembly which perturb the electron beam.

A typical apparatus utilized to fabricate an electron gun structure of a pickup tube is shown in FIG. 8 of U.S. Pat. No. 4,169,239 issued to Ehata et al. on Sept. 25, 1979. In FIG. 8 of the Ehata et al. patent, the insulating support rods are supported on beading bases which are rotated toward the stacked lens elements. As the Ehata et al. patent discloses, if the viscosity of the fused glass support rod is low, the accuracy with which the electrodes are assembled is decreased due to thermal and mechanical shock created at the time of molten supporting rod contacts the lens element support tabs.

It is known in the art that a secure but somewhat random placement of the insulating support rod on the beading base can be accomplished by providing the beading base with a vacuum holding capability. However, because of interrelated width tolerances between the support rod and the beading base, the support rod can be offset in a lateral direction during initial placement on the beading base.

An example of a structure for reducing the lateral movement of the support rod is shown in U.S. Pat. No. 3,609,400 issued to Marks et al. on Sept. 28, 1971. In the Marks et al. structure, the beading block includes a beading trough in which the insulating support rod is nested. The accuracy of the support rod alignment in the Marks et al. patent depends on the accuracy with which the width of the support rod can be controlled. The present industrial width tolerance for pressed multiform support rods up to 49 mm in length is ±0.254 mm. A secondary machining operation, after firing of the bead to outgas the bead and set its physical dimensions, is time consuming, expensive and thus impractical. It therefore is desirable to design a self-indexing insulating support rod that is substantially independent of the industrial width tolerance described above.

SUMMARY OF THE INVENTION

A novel electron gun assembly having at least one generally longitudinally-extending electron beam path includes a plurality of electrodes attached to at least two electrically-insulating support rods. Each of the support rods has a surface having at least two indexing cavities formed therein for aligning the support rods along the beam path.

BRIEF DESCRIPTION OF THE DRAWINGS

FIG. 1 is a broken-away, front, elevational view of an electron gun having a pair of prior art support rods.

FIG. 2 is a broken-away, side, elevational view along section line 2—2 of the electron gun shown in FIG. 1.

DETAILED DESCRIPTION OF THE PREFERRED EMBODIMENT

FIGS. 1 and 2 show structural details of a prior art electron gun assembly mounted in the neck of a cathode-ray tube, CRT. The structure of this electron gun assembly is similar to the electron gun assembly described in U.S. Pat. No. 3,772,554 issued to R. H. Hughes on Nov. 13, 1973. The insulating support rods in the Hughes structure are conventional.

Figure 4:
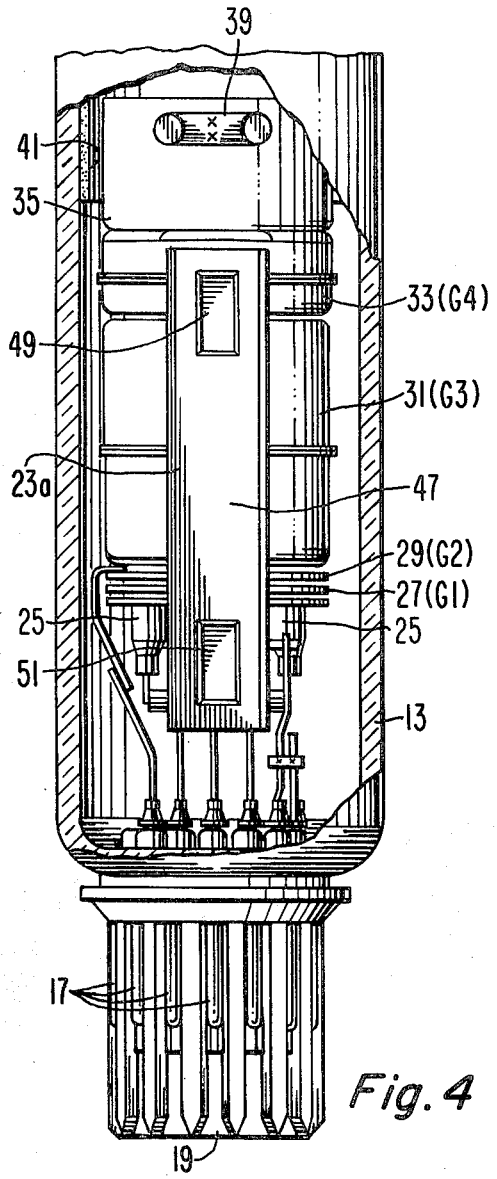
FIG. 4 is a broken-away, side, elevational view along line 4—4 of the section gun of FIG. 3.
Figure 3:
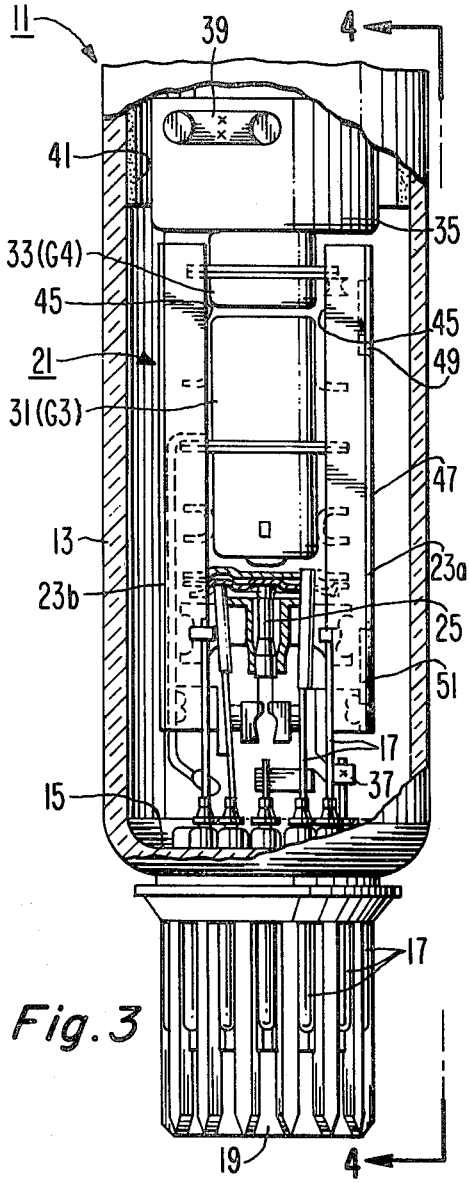
FIG. 3 is a broken-away, front, elevational view of an electron gun showing one embodiment of the novel self-indexing support rods.

An improved electron gun assembly, shown in FIGS. 3 and 4, includes an evacuated glass envelope 11, which in a complete CRT includes a rectangular faceplate panel and a funnel having a neck 13 integrally attached thereto. A glass stem 15 having a plurality of leads or pins 17 extending therethrough is sealed to and closes the end of the neck 13. A base 19 is attached to the pins 17 outside the envelope 11.

An in-line beaded bipotential electron gun assembly 21, centrally mounted within the neck 13, is designed to generate and project three electron beams along coplanar convergent paths having a common, generally longitudinal direction toward the viewing screen. The gun assembly comprises two glass support rods or beads **23*a* and 23*b* from which the various electrodes are supported to form a coherent unit in a manner commonly used in the art. These electrodes include three substantially equally transversely-spaced coplanar cathodes 25 (one for providing each beam), a control-grid electrode 27 (also referred to as G1), a screen-grid electrode 29 (also referred to as G2), a first accelerating and focusing electrode 31 (also referred to as G3), a second accelerating and focusing electrode 33 (also referred to as G4), and a shield cup 35, longitudinally-spaced in that order along the rods 23*a* and 23*b*. The various electrodes of the gun assembly 21 are electrically connected to the pins 17 either directly or through metal ribbons 37. The gun assembly 21 is held in a predetermined position in the neck 13 on the pins 17 and with snubbers 39 on the shield cups 35 which press on and make contact with an electrically conducting internal coating 41 on the inside surface of the neck 13. The internal coating 41** extends over the inside surface of the funnel and connects to the anode button (not shown).

Each of the novel support rods 23*a* and 23*b* is a parallelepiped member about 11 mm (millimeters) wide by about 48 mm long by about 4.25 mm thick. The rods 23*a* and 23*b* are formed by compacting or pressing a suitable glass powder in a mold. The rods are fired or glazed after molding to outgas the material, to fix the dimensions of the rods and to strengthen the rods and make them less likely to chip or crack. The support rods 23*a* and 23*b* have a mounting surface 45 and a beading support surface 47. A chamfer of about 30° is ground into both longitudinally-extending edges of the rods adjacent to the beading support surface 47 to facilitate the subsequent beading operation. The various electrodes 25–33 each include support tabs which are embedded into the mounting surface 45 of the support rods 23*a* and 23*b*. At least two indexing cavities 49 and 51 are formed into the beading support surface 47 of the support rods 23*a* and 23*b* during the molding operation. The indexing cavities 49 and 51 are located on the center line of the longitudinal bead axis. The indexing cavities 49 and 51 have the same lateral dimension; however, if one of the indexing cavities is of a different dimension than the other, a unique indexing can be achieved.

As shown in FIGS. 3 and 4, the indexing cavities 49 and 51 in the rods 23*a* and 23*b*, are substantially rectangular in shape and extend into the body of the rods to a depth of about 1.5 mm. The cavities 49 and 51 are typically about 5 mm long and about 3 mm wide. If the rods are fired or glazed with the indexing cavities 49 and 51 exposed to the glazing fires, the "as-pressed" geometry of the indexing cavities is not carried over into the fired rods. In this instance the cavities 49 and 51 take on a slight elliptical parabolic shape along both the major and minor axes of the rods. During the beading operation, the rods 23*a* and 23*b* are free-floating in the longitudinal direction because of the elongated indexing cavities 49 and 51 but constrained in the lateral direction.

Figure 5:
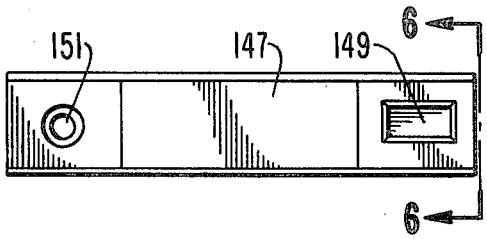
FIG. 5 is a plan view of a second embodiment of the novel self-indexing support rod.
Figure 6:
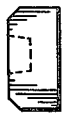
FIG. 6 is an end view along lines 6—6 of FIG. 5.

FIG. 5 shows an alternative embodiment of a novel indexed support rod 147. In this embodiment, a first indexing cavity 149 has a longitudinal dimension greater than its lateral dimension while a second indexing cavity 151 is substantially circular and provides a minimum surface area configuration. In this embodiment, the support rod is constrained, during the beading operation, in both the longitudinal and lateral directions. At least one of the indexing cavities, for example cavity 149, should be free-floating in the longitudinal direction in order to eliminate a tolerance on the spacing between the indexing cavities 149 and 151. The indexing cavity 149 is typically about 5 mm long by about 3 mm wide, while the cavity 151 has a diameter of about 3 mm. In a earlier support rod design using two minimum surface area indexing cavities, i.e., two circular cavities, it was determined that about 10 to 30 percent of the support bead were rejected after glazing because the dimension between the spaced-apart cavities was out of the tolerance variation permitted. The present designs with at least one free-floating indexing cavity do not have this cavity spacing problem.

In order to assemble electron guns using the novel self-indexing support rods 23*a* and 23*b*, the gun and lens elements are stacked on a mandrel (not shown). The support beads 23*a* and 23*b* are placed on a beading apparatus which includes at least a pair of bead blocks with truncated pyramidal indexing pins extending from the support surface of the beading blocks. The indexing pins project into the indexing cavities 49 and 51 of the support rods 23*a* and 23*b* and restrict the lateral movement of the support rods during the beading operation. By referencing the indexing pins to the indexing cavities 49 and 51 which lie along the center line of the support rods 23*a* and 23*b*, the support rod alignment is improved by a factor of two since the alignment cavity tolerance is equally distributed about the center line. The width dimension of the support rod is no longer a factor in controlling the lateral displacement of the rod. Furthermore, the improved accuracy with which support rods are laterally controlled and longitudinally aligned along the electron beam path assures that the electron lens elements are properly spaced within the gun and that the outer edges of the support tabs of the lens elements are fully embedded into and surrounded by the insulating support rods 23*a* and 23*b* thus eliminating the perturbation of the electron beams along the electron beam paths.

While described in terms of a color television tube having three electron beams projected along three convergent beam paths, it is understood that the self-indexing insulating support rods described herein can be used in any type of electron gun where accuracy of the support rods alignment is required.

What is claimed is:

1. In an electron-gun assembly having at least one generally longitudinally-extending electron beam path, said assembly comprising at least two elongated electrically-insulating support rods each rod having a mounting surface and a beading support surface with a plurality of electrodes attached by mounting means to said mounting surfaces of each of said support rods, the improvement wherein at least two indexing cavities are formed in said beading support surface of each of said support rods, whereby said rods are aligned along said beam path.

2. In an in-line electron gun assembly comprising at least two elongated electrically-insulating support rods, each of said support rods being a parallelepiped member having a mounting surface and an oppositely disposed beading support surface, a plurality of electrodes for producing and directing three electron beams along spaced coplanar paths having a common generally longitudinal direction, said electrodes being affixed to said mounting surface of each of said support rods, the improvement wherein at least two indexing cavities are formed in said beading support surface of each of said support rods, whereby said rods are aligned along said beam paths.

3. The electron gun assembly as in claim 2, wherein said indexing cavities are formed along the center line of the major axis of each of said support rods.

4. The electron gun assembly as in claim 3, wherein at least one of said indexing cavities is elongated along the major axis of said support rod.

5. The electron gun assembly as in claim 3, wherein one of said indexing cavities has a minimum surface area configuration and the second of said indexing cavities is elongated along the major axis of said support rod.

* * * * *

UNITED STATES PATENT AND TRADEMARK OFFICE

CERTIFICATE OF CORRECTION

PATENT NO. : 4,400,644

DATED : 8/23/83

INVENTOR(S) : John R. Hale

It is certified that error appears in the above-identified patent and that said Letters Patent is hereby corrected as shown below:

Column 1, Line 47 - "of molten" should be -- the molten -- ;

Column 2, Line 24 - "section gun" should be -- electron gun -- ; and

Column 2, Line 57 - "(one for providing each beam)" should be -- (one for producing each beam) -- .

Signed and Sealed this

*Third* Day of *April 1984*

[SEAL]

*Attest:*

GERALD J. MOSSINGHOFF

*Attesting Officer*

*Commissioner of Patents and Trademarks*